United States Patent [19]

Klund et al.

[11] 4,042,445

[45] Aug. 16, 1977

[54] STAMP AND LEGEND APPLICATING MACHINE

[75] Inventors: Robert N. Klund, Stillwater; James S. Weidenbach, Anoka, both of Minn.

[73] Assignee: Delkor Industries, Inc., Minneapolis, Minn.

[21] Appl. No.: 686,742

[22] Filed: May 17, 1976

[51] Int. Cl.[2] ..... B43M 13/00

[52] U.S. Cl. ..... 156/385; 156/521; 156/566

[58] Field of Search ..... 156/277, 384, 385, 388, 156/441.5, 442, 522, 528, 556, 566, 568; 101/95, 99

[56] References Cited

U.S. PATENT DOCUMENTS

| | | | |
|---|---|---|---|
| 1,956,862 | 5/1934 | Gantz | 156/385 |
| 3,291,675 | 12/1966 | Orloff et al. | 156/385 |
| 3,346,439 | 10/1967 | Bollman et al. | 156/522 |
| 3,393,113 | 7/1968 | Houss | 156/522 |
| 3,578,525 | 5/1971 | Mueller | 156/385 |
| 3,802,941 | 4/1974 | Whiteford et al. | 156/442 |
| 3,810,407 | 5/1974 | Klund et al. | 156/522 |

*Primary Examiner*—Caleb Weston

*Attorney, Agent, or Firm*—Schroeder, Siegfried, Ryan & Vidas

[57] ABSTRACT

A stamp and legend applicating machine including a stamp-applying wheel having a groove in its circumferential surface in which a printer member is mounted adjacent the stamp dispensing slot of the wheel to apply any desired legend upon the envelope immediately adjacent the applied stamps.

9 Claims, 5 Drawing Figures

STAMP AND LEGEND APPLICATING MACHINE

Our invention is related and adapted to be utilized with a stamp applicating machine of the type shown in U.S. Pat. No. 3,810,407 or any one of U.S. Pat. Nos. 3,346,439; 3,393,113; or 3,487,989. Each of these patents discloses stamp applicating machines which utilize a rotary wheel for applying the stamps to the envelopes as they move through the machine. The stamp applicating machine disclosed herein is of the type shown in U.S. Pat. No. 3,810,407 and further reference may be made thereto for details in construction over and above those set forth herein.

It is a general object of our invention to provide a novel and improved stamp applicating machine of simple and inexpensive construction and increased capability.

A more specific object is to provide a novel and inexpensive stamp applicating machine capable of simultaneously applying any desired legend to the envelopes in most any position relative to the stamps which are applied.

Another object is to provide a novel and improved stamp applicating machine capable of applying any desired legend to the envelopes in exactly the same position relative to the applied stamps for each envelope which passes through the machine.

Another object is to provide a novel and simple machine for applying any desired legend in a simple, quick and efficient manner without any additional expense or time being required.

These and other objects and advantages of my invention will more fully appear from the following description, made in connection with the accompanying drawings, wherein like reference characters refer to the same or similar parts throughout the several views, in which.

Figure 1:
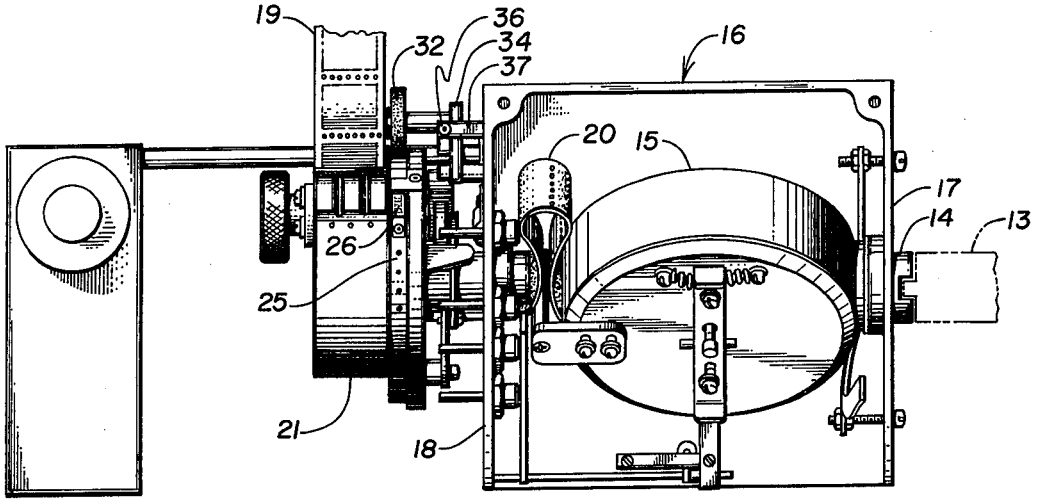
FIG. 1 is a plan elevational view of a stamp and legend applicating machine incorporating our invention.
Figure 2:
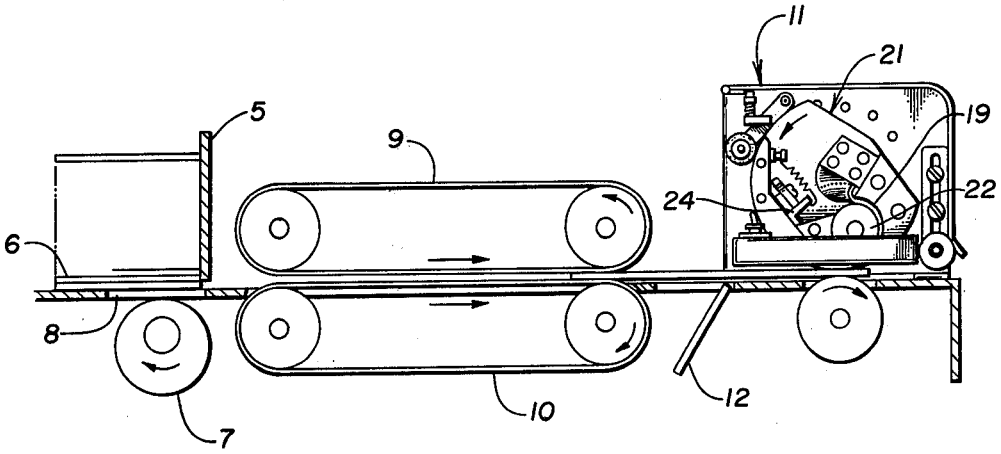
FIG. 2 is a diagrammatic view illustrating operation of the envelope advancing mechanism relative to our stamp and legend applicating machine.

One embodiment of our invention, as shown in FIGS. 1–4, is designed for use in combination with an envelope advancing mechanism which, as best shown in FIG. 2, is designed to select and move envelopes successively into and through stamp applicating machines such as one of the type shown in U.S. Pat. No. 3,810,407. As shown in FIG. 2, it includes an envelope container 5 with envelopes 6 therein, which are engaged by a cam feeding wheel 7 through an opening 8 which causes the envelopes to be moved forwardly to be engaged by a pair of endless belts 9 and 10, which are arranged one immediately above the other so as to progress the envelopes and discharge them in the direction of the arrows, as seen in FIG. 2, to the stamp applicating machine which has been indicated generally by the numeral 11. As shown in FIG. 2, each envelope, as it leaves the endless belts 9 and 10 engages pivoted trip lever 12 which actuates a drive shaft 13 which in turn causes the main drive shaft 14 to rotate about its longitudinal axis one complete turn. Reference to FIG. 1 illustrates the manner in which the drive shaft 13 engages the main drive shaft 14 and causes the same to revolve, carrying with it the open end cylinder which functions as a carrying with it the open end cylinder which functions as a stamp roll holder 15. As best seen in FIG. 1, the main drive shaft 14 is rotatably mounted within a frame 16 which includes end walls 17 and 18 through which the shaft 14 extends. A roll of stamps, not shown, is carried within the stamp roll holder 15 and the stamps 19 are drawn therefrom by the mechanism and in the manner described in U.S. Pat. No. 3,810,407. In like manner, the tape of stamps extends through the shaft 14 and the side wall 18 into the stamp applying wheel which has been identified generally by the numeral 21. As best seen in FIGS. 1 and 2, the stamps 19 pass through a stamp metering mechanism 22 and are projected outwardly through an axially extending slot 23 which is formed in the circumferential surface of the wheel 21. A stamp shearing mechanism 24 is also provided to sever the stamps after they have been metered and dispensed through the slot 23 immediately after they have been applied to the envelope, as shown in FIG. 2. Reference may be made to U.S. Pat. No. 3,810,407 for further details of all of the above construction.

Figure 3:
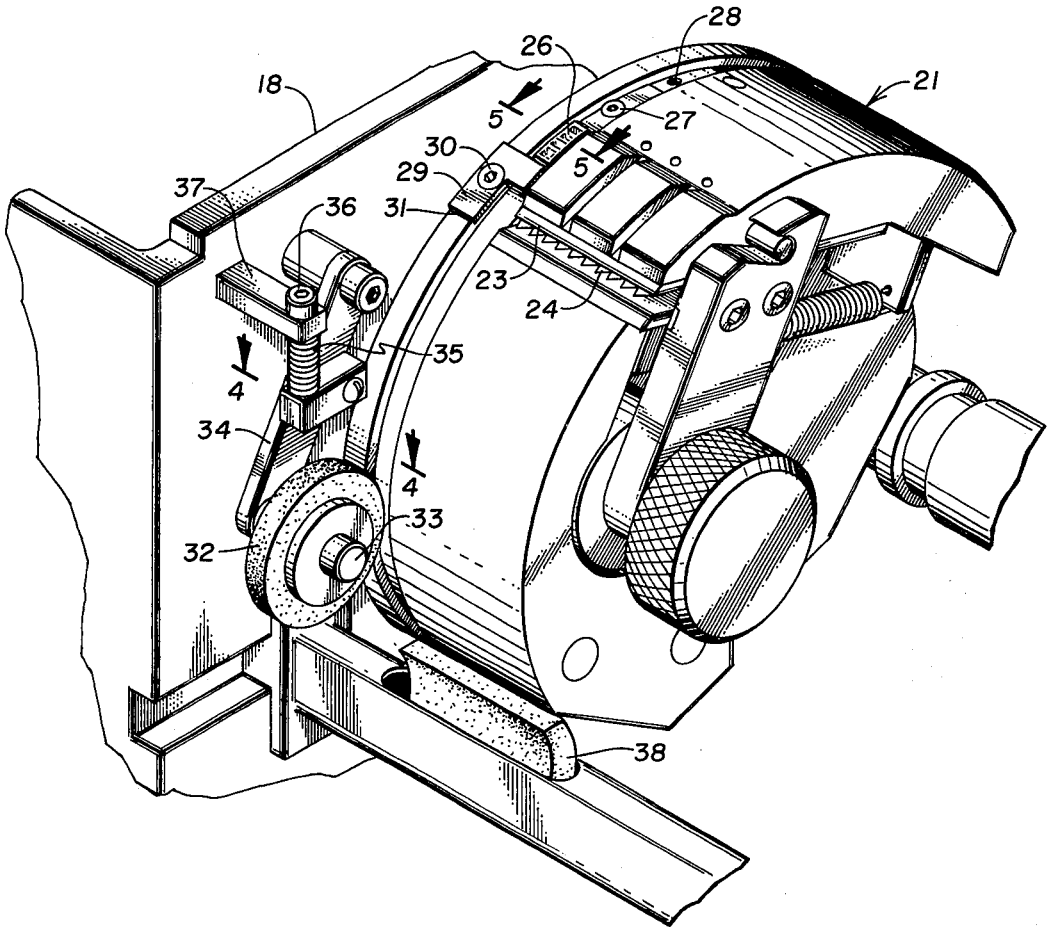
FIG. 3 is a fragmentary perspective view taken on enlarged scale from one end of our machine and showing in detail the mechanism for applying the legend to the envelope along with the stamps.
Figure 5:
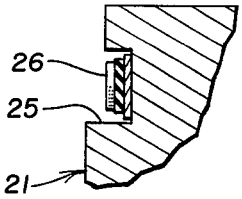
FIG. 5 is a fragmentary sectional view on an enlarged scale taken along line 5—5 of FIG. 3.

Formed in the outer surface of the wheel 21 and extending circumferentially thereof adjacent the slot 23 is a groove 25 within which a printer member 26 is secured by means of a screw 27 adjacent its rearward end, the screw extending into one of a plurality of holes 28 formed in the bottom wall of the groove. The forward end of the printer member is held in place by an L-shaped pressure plate 29 which is similarly secured by a securing member 30. The L-shaped pressure plate 29 is received within a recess 31 which is formed within the grooved defining wall opposite the slot 23, as best seen in FIG. 3. Printer member 26 carries any desired legend which the operator may wish to apply to the envelope and extends slightly upwardly above the upper confines of the groove 25. It will be noted that the printer member 26 trails the slot 23 slightly as the wheel 21 rotates in the direction indicated by the arrow in FIG. 2.

Figure 4:
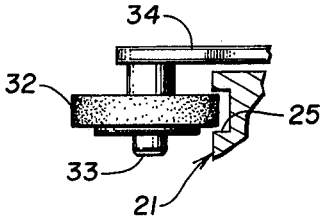
FIG. 4 is a fragmentary sectional view taken along the line 4—4 of FIG. 3.

Mounted on the side wall 18 is a rotary inking pad 32. This inking pad is rotatably mounted on a stub shaft 33 carried by a pivotal lever 34 which is pivotally mounted upon the end wall 18, as show in FIG. 3. The lever 34 is constantly urged downwardly by the spring loading 35 which may be adjusted by turning the screw 36, which is carried by a mounting arm 37. The loading is such that the rotary inking pad 32 normally extends slightly into the confines of the groove 25, as best seen in FIG. 4, so that when the wheel 21 rotates, the printer member 26 will come in contact with the surface of the inking pad 32 and pick up sufficient ink so that when the stamps have been metered and passed by the wick 38, and severed, the legend will be applied to the envelope directly adjacent and opposite the stamps as they are applied to the envelope by the wheel 21. In this manner, any desired legend can be applied to the envelope at exactly the same position desired relative to the stamps, for each envelope which passes through the stamp applicating machine. If it is desired to alter the position of the legend or to utilize a longer legend, this can be accomplished through the use of the securing openings 28.

From the above, it can be seen that we have provided an extremely novel and simple device for applying any desired legend in exactly the same position to the envelopes as they pass through the stamp applicating machine, so that the end product will be uniform and attractive in appearance. The spacing and arrangement relative to the stamps will be uniform and always in the desired position. In all respects other than those stated to the contrary herein, the structure and operation of the stamp and legend applying machine described herein conforms in all essential respects with the structure and operation of the stamp applicating machine shown in U.S. Pat. No. 3,810,407.

It will, of course, be understood that various changes may be made in the form, details, arrangement and proportions of the parts without departing from the scope of our invention which consists of the matter shown and described herein and set forth in the appended claims.

We claim:

1. In a postage stamp applying machine including a frame, a stamp roll holder mounted on said frame, a driven stamp metering mechanism carried by said frame for withdrawing stamps from said stamp roll holder and metering the same, means connected to said mechanism for driving the same, and means carried by said frame for moistening and severing such stamps after they have been metered by said mechanism, the improvement comprising:

a. a postage stamp applying wheel rotatably mounted on said frame and constructed and arranged to receive postage stamps from said metering mechanism and having an axially extending slot formed in its circumferential surface through which stamps are metered by said metering mechanism, said wheel having a circumferentially extending groove adjacent said slot formed in its circumferential surface, b. a printer member mounted within said groove and extending slightly radially outwardly therebeyond, c. inking means mounted adjacent the groove of said wheel in position to engage and apply ink to said printer member as said wheel rotates said member thereby, and d. means carried by said frame and synchronized with said stamp metering mechanism for rotating said wheel to cause stamps to be applied to envelopes as they pass below said wheel.

2. The structure defined in claim 1 wherein said printer member is positioned within said groove to trail said slot of said wheel as the latter rotates and applies stamps.

3. The structure defined in claim 1 wherein said printer member is located within said groove immediately adjacent said slot in trailing relation as said wheel rotates and applies stamps.

4. The structure defined in claim 1 wherein said inking means is comprised of a rotary inking pad rotatably mounted on said frame.

5. The structure defined in claim 1 wherein said inking means is comprised of a rotary inking pad rotatably and yieldably mounted on said frame adjacent said groove of said wheel.

6. The structure defined in claim 1 wherein said wheel as a groove-defining wall which is relieved opposite said slot, and a pressure plate is mounted within the relieved portion of said wall and overlies a leading end portion of said printer member to secure the same within said groove.

7. The structure defined in claim 1 wherein said groove of said stamp applying wheel has a bottom wall which is adapted at various points along its circumferential length to have a printer member secured thereto.

8. The structure defined in claim 1 wherein said inking means is rotary in nature and is pivotally mounted on said frame and is resiliently biased against said printer member as the latter passes and is engaged thereby.

9. In a postage stamp applying machine including a frame, a stamp roll holder mounted on said frame, a driven stamp metering mechanism carried by said frame for withdrawing stamps from said stamp roll holder and metering the same, means connected to said mechanism for driving the same, and means carried by said frame for moistening and severing such stamps after they have been metered by said mechanism, the improvement comprising:

a. a postage stamp applying wheel rotatably mounted on said frame and constructed and arranged to receive postage stamps from said metering mechanism and having an axially extending slot formed in its circumferential surfaces through which stamps are metered by said metering mechanism, b. a printer member mounted on the external surface of said wheel adjacent said slot, c. inking means mounted adjacent said wheel in position to engage and apply ink to said printer member as said wheel rotates said member thereby, and d. means carried by said frame and synchronized with said stamp metering mechanism for rotating said wheel to cause stamps to be applied to envelopes as they pass below said wheel.

* * * * *